US006652367B1

(12) United States Patent
Lin

(10) Patent No.: US 6,652,367 B1
(45) Date of Patent: Nov. 25, 2003

(54) DRILL BIT GRINDING DEVICE

(76) Inventor: Cheng-Fu Lin, No. 22, Lane 25, Fu-An 5th St., Hsi-Tun Dist. Taichung City (TW)

( * ) Notice: Subject to any disclaimer, the term of this patent is extended or adjusted under 35 U.S.C. 154(b) by 0 days.

(21) Appl. No.: 10/272,034

(22) Filed: Oct. 15, 2002

(30) Foreign Application Priority Data

May 21, 2002 (TW) ..... 91207283 U

(51) Int. Cl.[7] ..... B24B 7/00

(52) U.S. Cl. ..... 451/178; 451/179; 451/231; 451/215; 451/375; 451/287

(58) Field of Search ..... 451/48, 178, 182, 451/231, 179, 358, 375, 376, 387, 405, 212, 213, 214, 215

(56) References Cited

U.S. PATENT DOCUMENTS 3,828,480 A * 8/1974 Weng
4,023,552 A * 5/1977 Moores, Jr. et al.
4,485,596 A * 12/1984 Bernard et al.
4,769,955 A * 9/1988 Reiling
5,649,853 A * 7/1997 Kuo ..... 451/178

* cited by examiner

*Primary Examiner*—Eileen P. Morgan
(74) *Attorney, Agent, or Firm*—Townsend and Townsend and Crew, LLP

(57) ABSTRACT

A grinding device includes a rotary grinding wheel having an annular grinding surface, a first grinding seat located in front of the grinding wheel, a sleeve disposed rotatably within a through hole in the first grinding seat, an abrasion measuring device for measuring amount of flank portions of a drill bit to be ground, and a tubular holding unit for holding releaseably the drill bit therein. The holding unit is sleeved on the drill bit, is disposed initially in the abrasion measuring device so as to fix position of the drill bit within the holding unit, and is then transferred into the first grinding seat for grinding the flank portions of the drill bit.

12 Claims, 19 Drawing Sheets

DRILL BIT GRINDING DEVICE

BACKGROUND OF THE INVENTION

1. Field of the Invention

The invention relates to a grinding device, more particularly to a drill bit grinding device.

2. Description of the Related Art

Referring to FIGS. 1 and 2, a commonly used drill bit 10 is shown to include a shank portion 11, a tip portion 13 opposite to the shank portion 11, and a body portion 12 between the shank and tip portions 11, 13. The tip portion 13 is formed with an apex 134, two cutting edges 133 defining a tip angle (A) (see FIG. 15) therebetween, two diametrically opposed lip portions 132, and two diametrically opposed flank portions 131, each of which is formed between a respective one of the cutting edges 133 and a respective one of the lip portions 132. The body portion 12 is formed with a pair of twisted flutes 121. Grinding swarfs are discharged via the flutes 121.

When the tip portion 13 of the drill bit 10 is worn out during the drilling operation, the apex 134 of the drill bit 10 becomes dull such that the drilling effect of the drill bit 10 is diminished and that resistance during a subsequent drilling operation is increased. As such, the flank and lip portions 131, 132 of the drill bit 10 have to be ground by a grinder (not shown) to sharpen the apex 134. However, the flank portions 131 are ground to form a sharpened tip angle (A) (see FIG. 15) based on a worker's experience such that it is difficult to grind the drill bit 10 to form accurately a standardized tip angle (A) (see FIG. 15), e.g., at 90°, 118°, 150°, etc.

To overcome the above-mentioned drawbacks, many kinds of positioning devices for the drill bit 10 have been proposed heretofore, the main purpose of which is to position the drill bit 10 adjustably with respect to a grinding surface. However, control of the amount of the drill bit 10 to be ground is neglected by these devices. Furthermore, the structures of these positioning devices are somewhat complicated such that corresponding operations of holding and positioning the drill bit 10 are difficult to conduct. Moreover, since the flank and lip portions 131, 132 of the drill bit 10 have. to be ground individually, and since the angles between the axis of the drill bit 10 and. the surfaces of the flank portions 131 are different from those between the axis of the drill bit 10 and the surfaces of the lip portions 132, the position of the drill bit 10 has to be changed four times to complete the grinding operation. Each position change of the drill bit 10 includes the steps of unlocking and locking of the drill bit 10 with respect to a grinding seat (not shown), thereby resulting in a complex grinding operation.

SUMMARY OF THE INVENTION

Therefore, the main object of the present invention is to provide a drill bit grinding device that is easy to operate and that can measure the amount of the drill bit to be ground.

According to this invention, a grinding device includes a rotary grinding wheel having an annular grinding surface, a first grinding seat located in front of the grinding wheel, a sleeve disposed rotatably within a through hole in the first grinding seat, an abrasion measuring device for measuring amount of flank portions of a drill bit to be ground, and a tubular holding unit for holding releaseably the drill bit therein. The holding unit is sleeved on the drill bit, is disposed initially in the abrasion measuring device so as to fix position of the drill bit within the holding unit, and is then transferred into the first grinding seat for grinding the flank and lip portions of the drill bit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
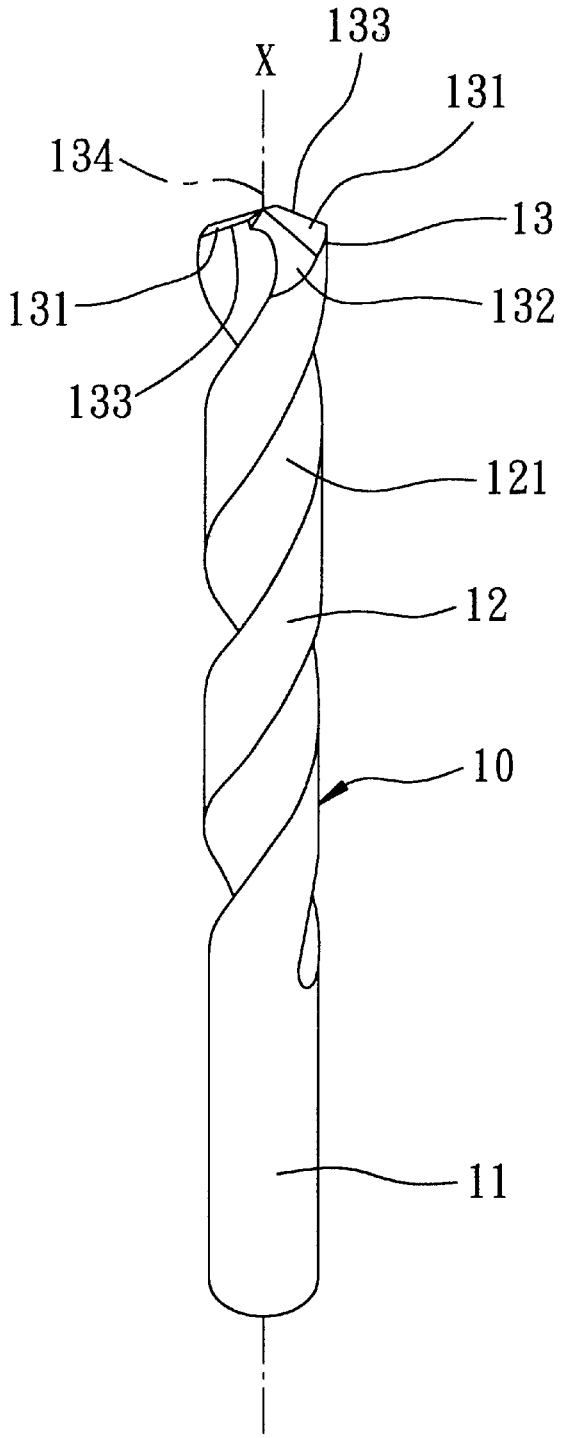
FIG. 1 PRIOR ART
FIG. 1 is a perspective view of a commonly used drill bit.
Figure 2:
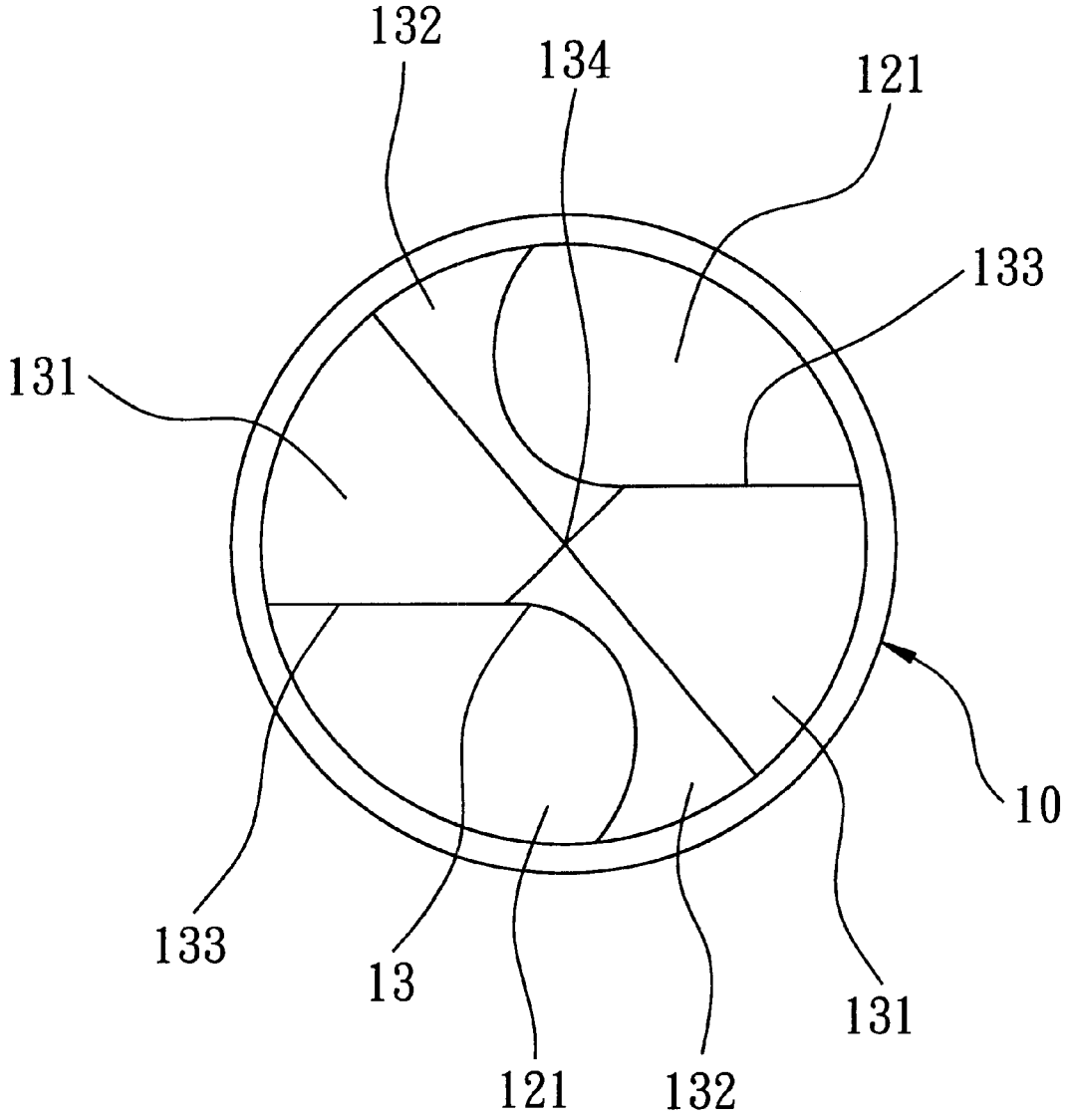
FIG. 2 PRIOR ART
FIG. 2 is a schematic top view illustrating a tip portion of the drill bit.
Figure 3:
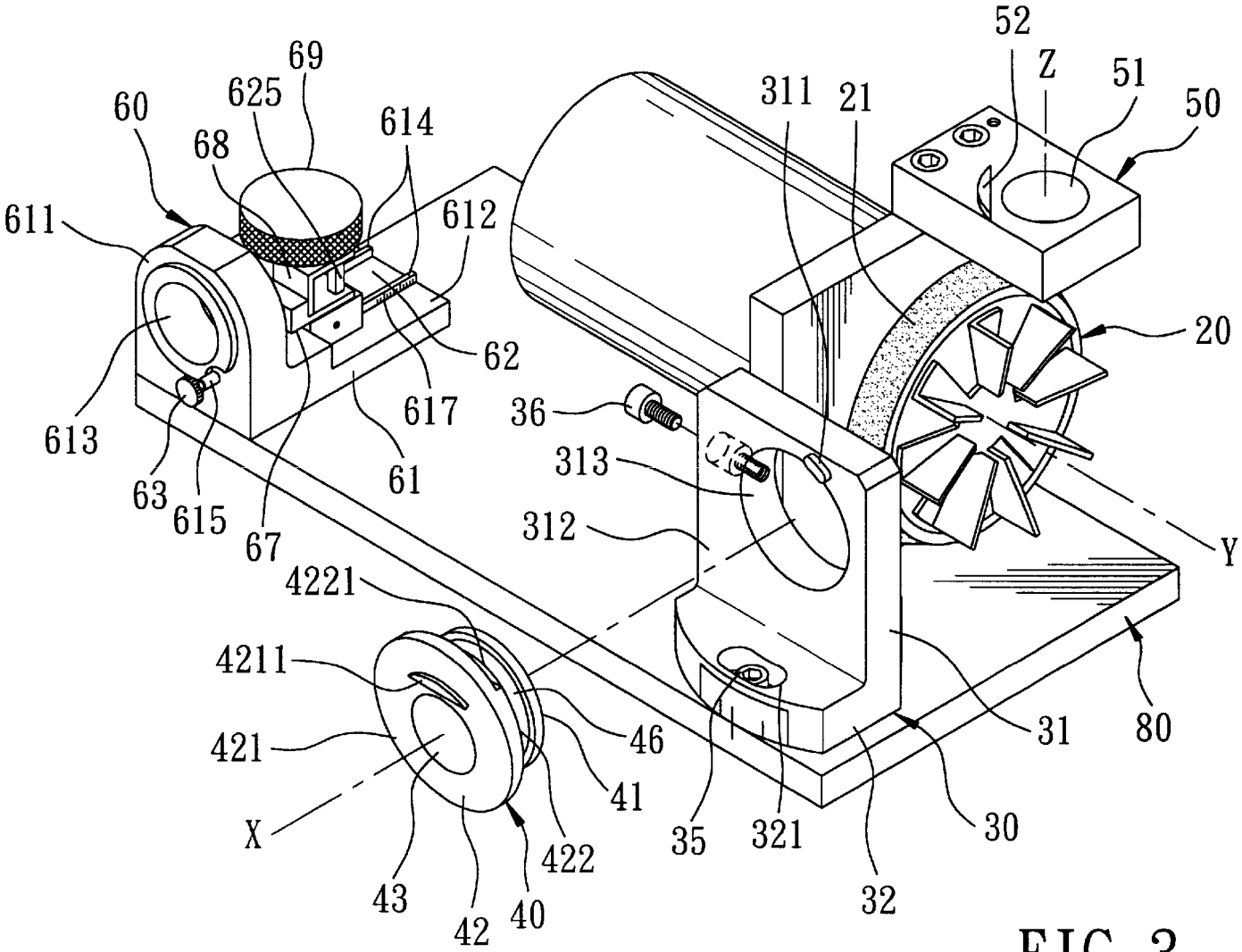
FIG. 3 is a partly exploded perspective view of a grinding wheel, a first grinding seat, a sleeve, a second grinding seat, and an abrasion measuring device of the preferred embodiment of a drill bit grinding device according to the present invention.
Figure 4:
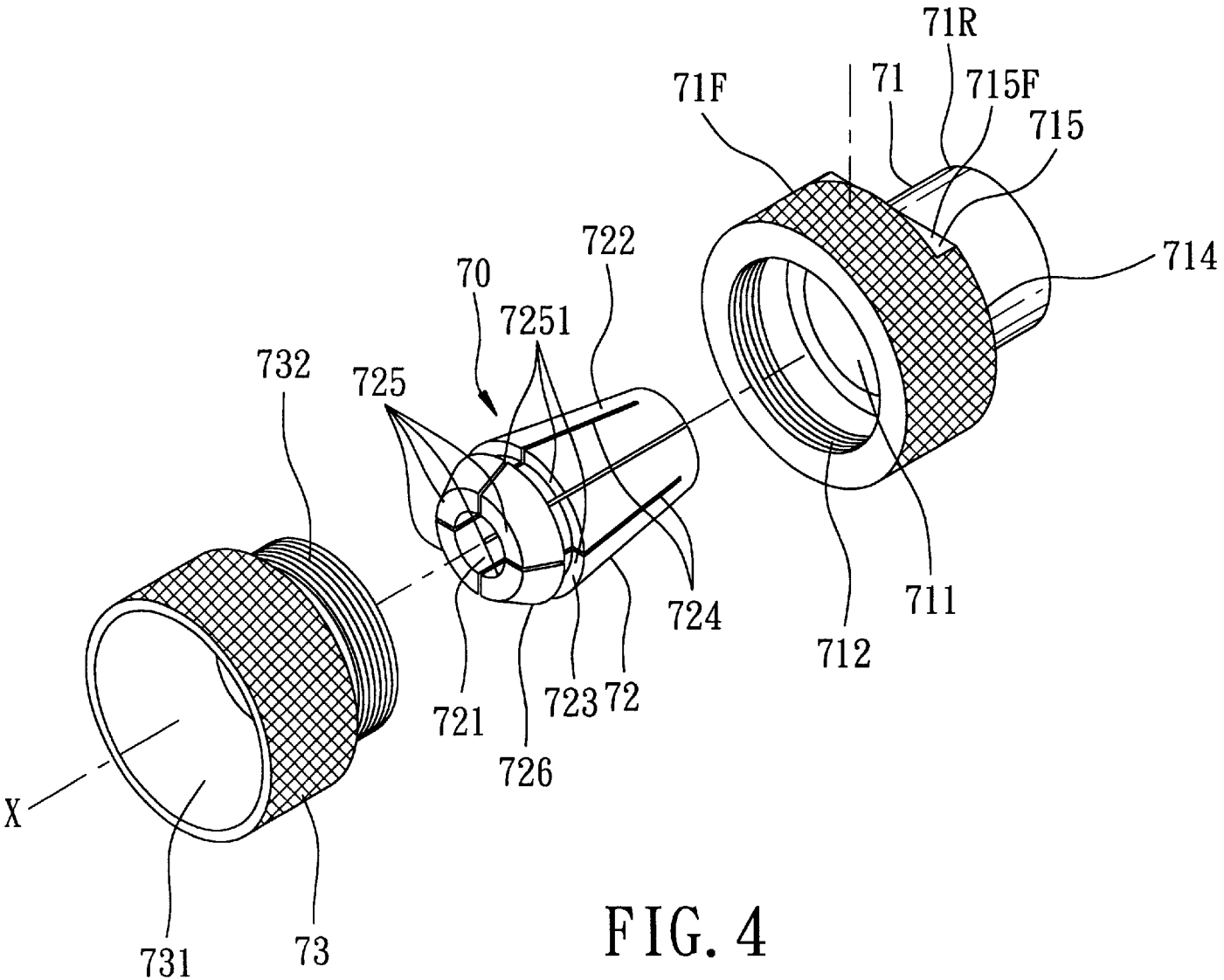
FIG. 4 is an exploded perspective view showing a holding unit of the preferred embodiment.
Figure 5:
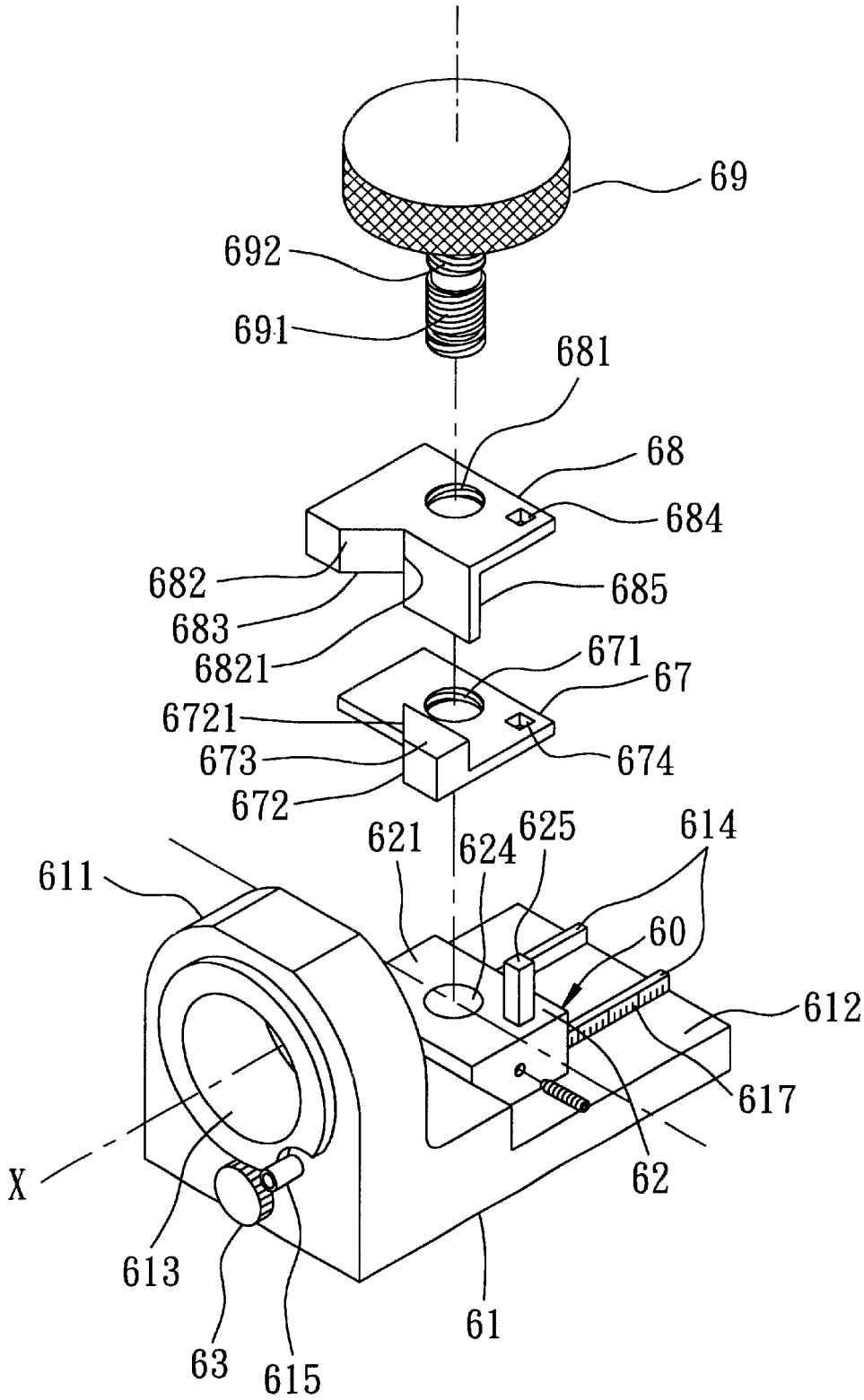
FIG. 5 is a partly exploded perspective view of the abrasion measuring device of the preferred embodiment.

Referring to FIGS. 1 to 3, the preferred embodiment of a grinding device according to the present invention is shown to be adapted for grinding a drill bit 10. The drill bit 10 includes a shank portion 11, a tip portion 13 opposite to the shank portion 11, and a body portion 12 between the shank and tip portions 11, 13. The tip portion 13 is formed with an apex 134, two cutting edges 133 that define a tip angle (A) (see FIG. 15) therebetween, two diametrically opposed lip portions 132, and two diametrically opposed flank portions 131, each of which is formed between a respective one of the cutting edges 133 and a respective one of the lip portions 132. The grinding device comprises a horizontal base plate 80, a rotary grinding wheel 20, a first grinding seat 30, a sleeve 40, a second grinding seat 50, an abrasion measuring device 60, and a tubular holding unit 70 (see FIGS. 4 and 6).

Figure 15:
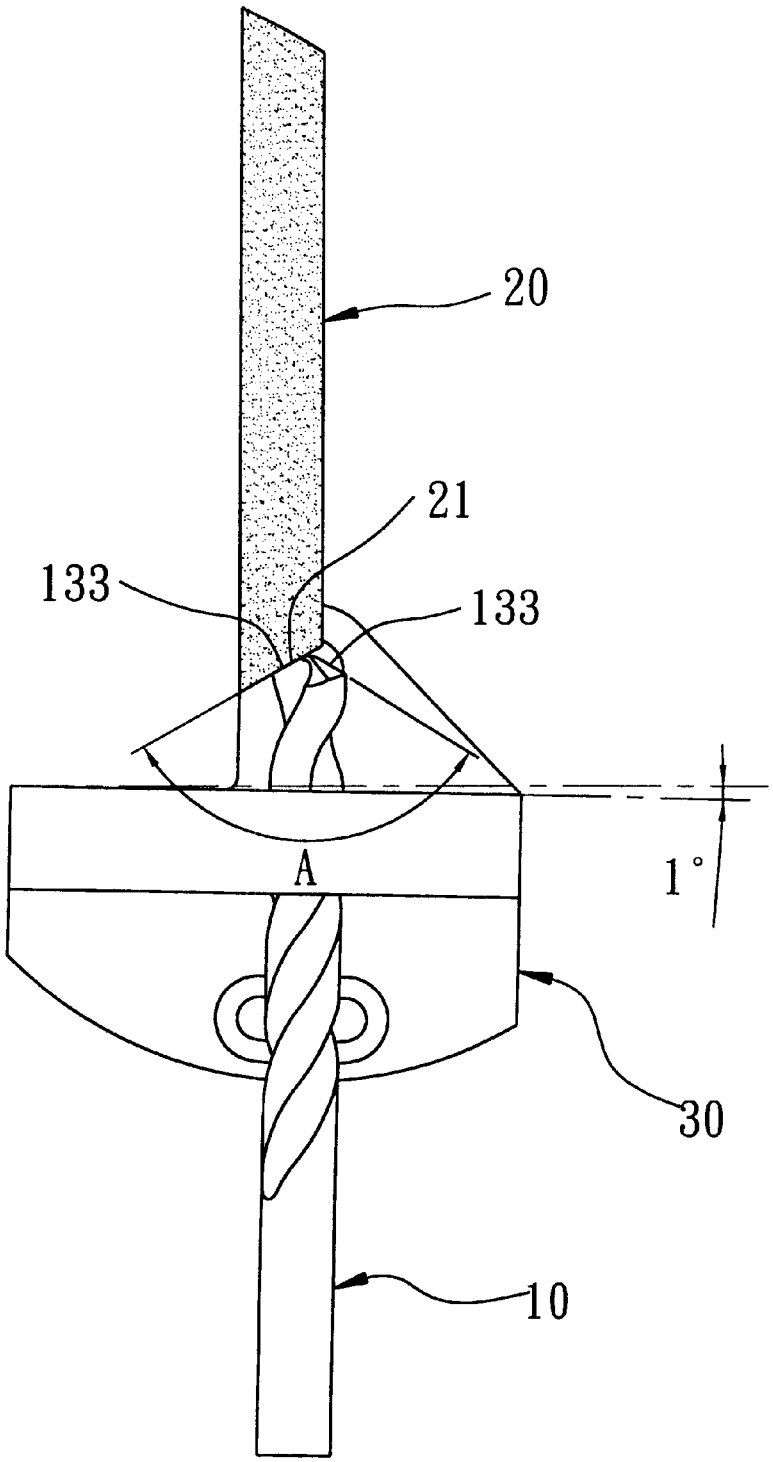
FIG. 15 illustrates angular relationship of the first grinding seat relative to the grinding wheel.

The rotary grinding wheel 20 is disposed rotatably on the base plate 80, and has an annular grinding surface 21 that is rotatable about a horizontal Y-axis. The grinding surface 21 has an inclination angle of about 60° with respect to the Y-axis, as best illustrated in FIG. 15.

Figure 3A:
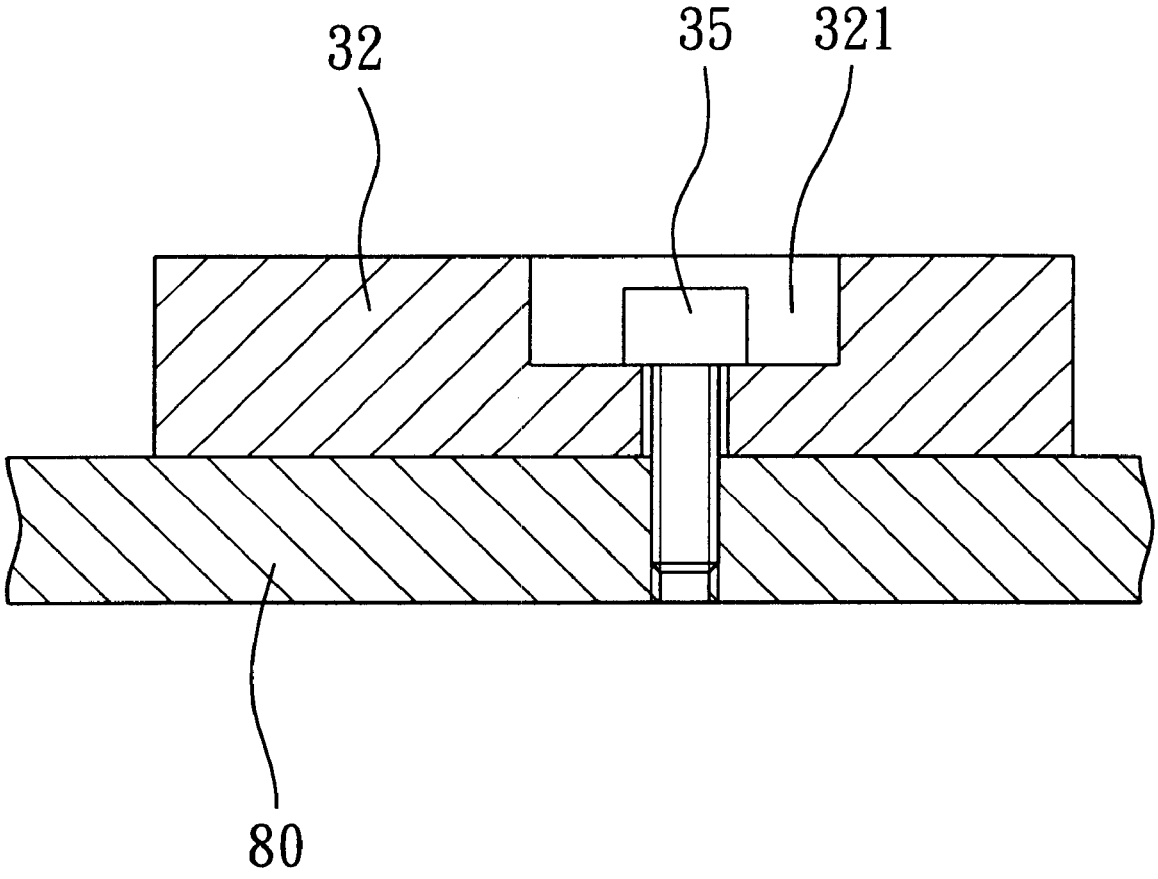
FIG. 3A illustrates how the first grinding seat is locked on a base plate.

The first grinding seat 30 is disposed adjustably on the base plate 80, is located in front of the grinding wheel 20, and is adjustable so as to vary the tip angle (A) (see FIG. 15) of the drill bit 10 to be formed. The tip angle (A) is measured from one of the cutting edges 133 to the other cutting edge 133 of the drill bit 10, as shown in FIG. 15. The first grinding seat 30 is formed with a through hole 313 that extends along a horizontal X-axis which is perpendicular to the Y-axis, and includes a vertical plate 31, a horizontal bottom plate 32, and a first bolt 35. The vertical plate 31 is formed with the through hole 313 in the first grinding seat 30, and has a front surface 312 that is formed with a curved limiting projection 311. The horizontal bottom plate 32 extends integrally and forwardly from a lower end of the vertical plate 31, and is formed with a curved slot 321 that extends therethrough along a vertical direction. The first bolt 35 extends through the slot 321 in the bottom plate 32, and is connected threadedly to the base plate 80, as shown in FIG. 3A, so as to lock the bottom plate 32 releasably on the base plate 80, thereby permitting adjustment of the tip angle (A) (see FIG. 15) of the drill bit 10 to be formed. The first grinding seat 30 further includes a limiting screw 36 that is fixed to the vertical plate 31.

Figure 9:
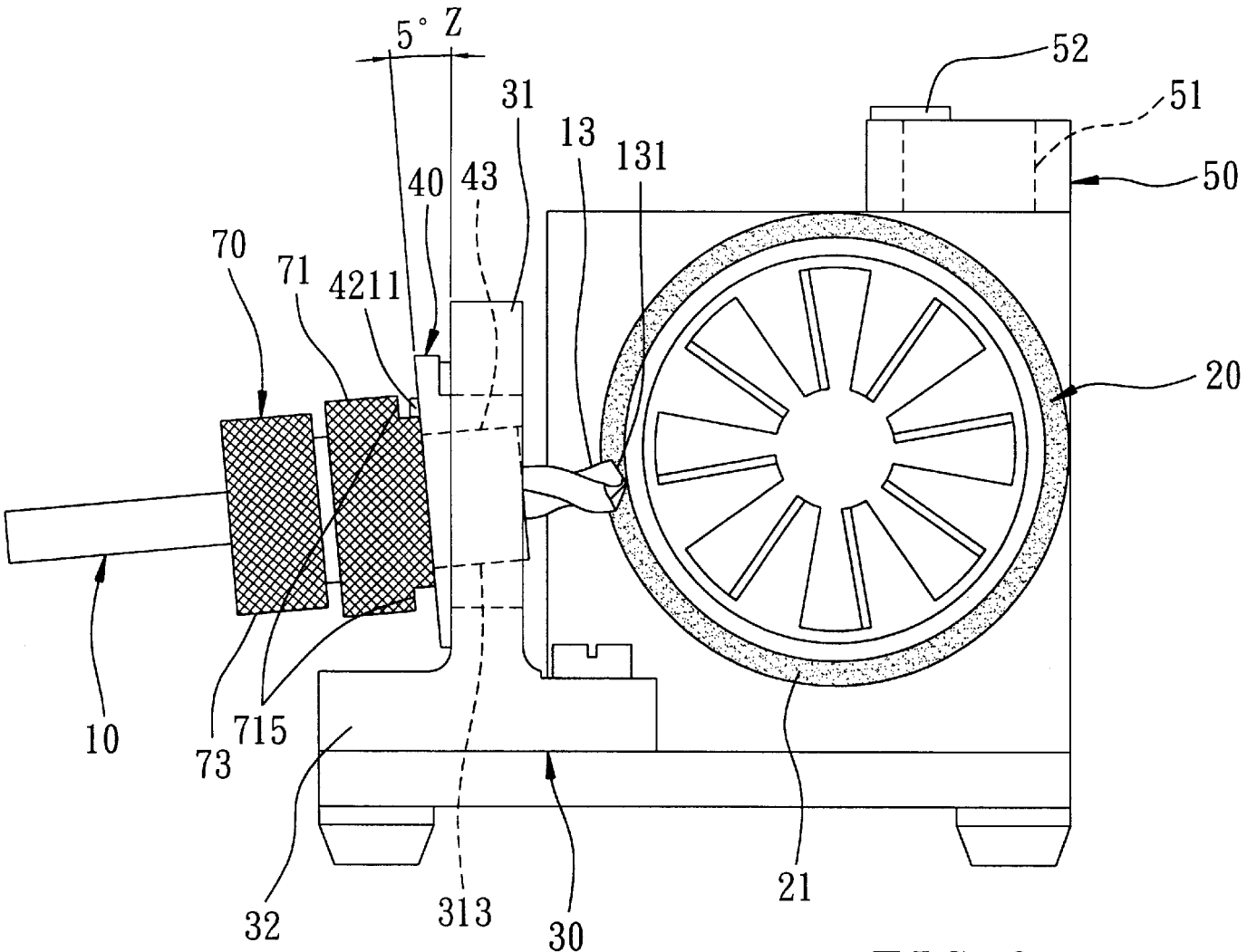
FIG. 9 illustrates a flank portion of the drill bit abutting against a grinding surface of the grinding wheel.
Figure 10:
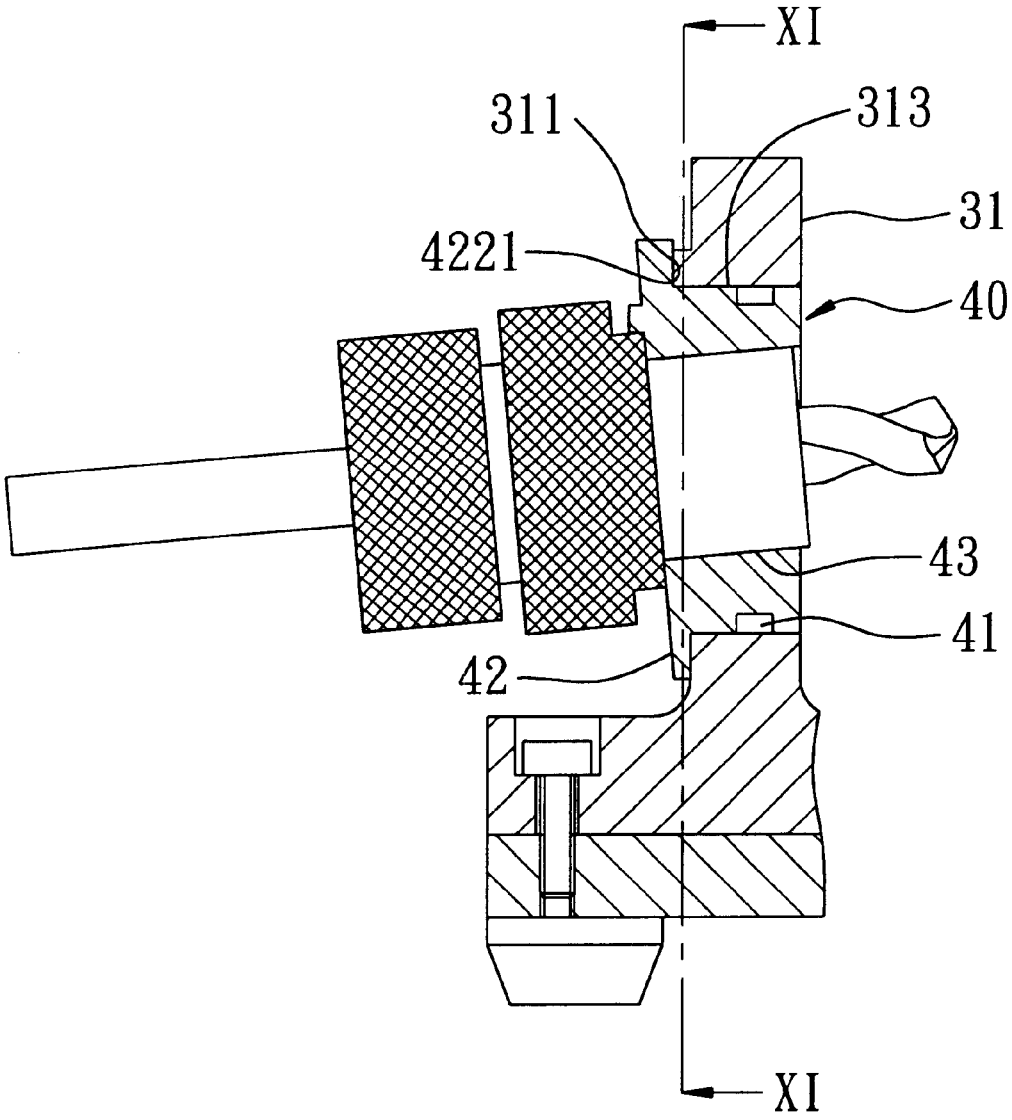
FIG. 10 illustrates how an engagement portion of the sleeve engages a limiting projection of the first grinding seat.

The sleeve 40 is disposed rotatably within the through hole 313 in the first grinding seat 30 so as to permit rotation of the sleeve 40 relative to the first grinding seat 30 by a predetermined angle. The sleeve 40 includes a rear flange 41 disposed at a rear end of the sleeve, 40, a front flange 42 disposed at a front end of the sleeve 40 and having a front end surface 421 and a rear end surface 422, and an eccentric hole 43. The front end surface 421 of the front flange 42 is inclined, and forms an angle of about 5° with respect to a vertical line, as shown in FIG. 9. An engagement portion 4211 is formed on the front end surface 421 of the front flange 42, and is configured as a frontwardly protruding rib extending in a direction parallel to the Y-axis. The rear end surface 422 of the front flange 42 is formed with a peripheral notch 4221. The eccentric hole 43 is formed through the rear and front flanges 41, 42, extends in a direction that is inclined with respect to the X-axis, and extends along a straight path that is perpendicular to the front end surface 421 of the front flange 42 and that is inclined rearwardly and upwardly, as shown in FIGS. 9 and 10. The sleeve 40 further has an outer surface formed with an annular retention groove 46, which is defined between the rear and front flanges 41, 42 and which engages the limiting screw 36 of the first grinding seat 30 so as to limit rotation of the sleeve 40 within the through hole 313 in the vertical plate 31.

The second grinding seat 50 is mounted fixedly on the base plate 80, is located over the grinding wheel 20, and is formed with a through hole 5l, and a horizontal top surface with a limiting piece 52 that protrudes integrally and upwardly therefrom.

Figure 6:
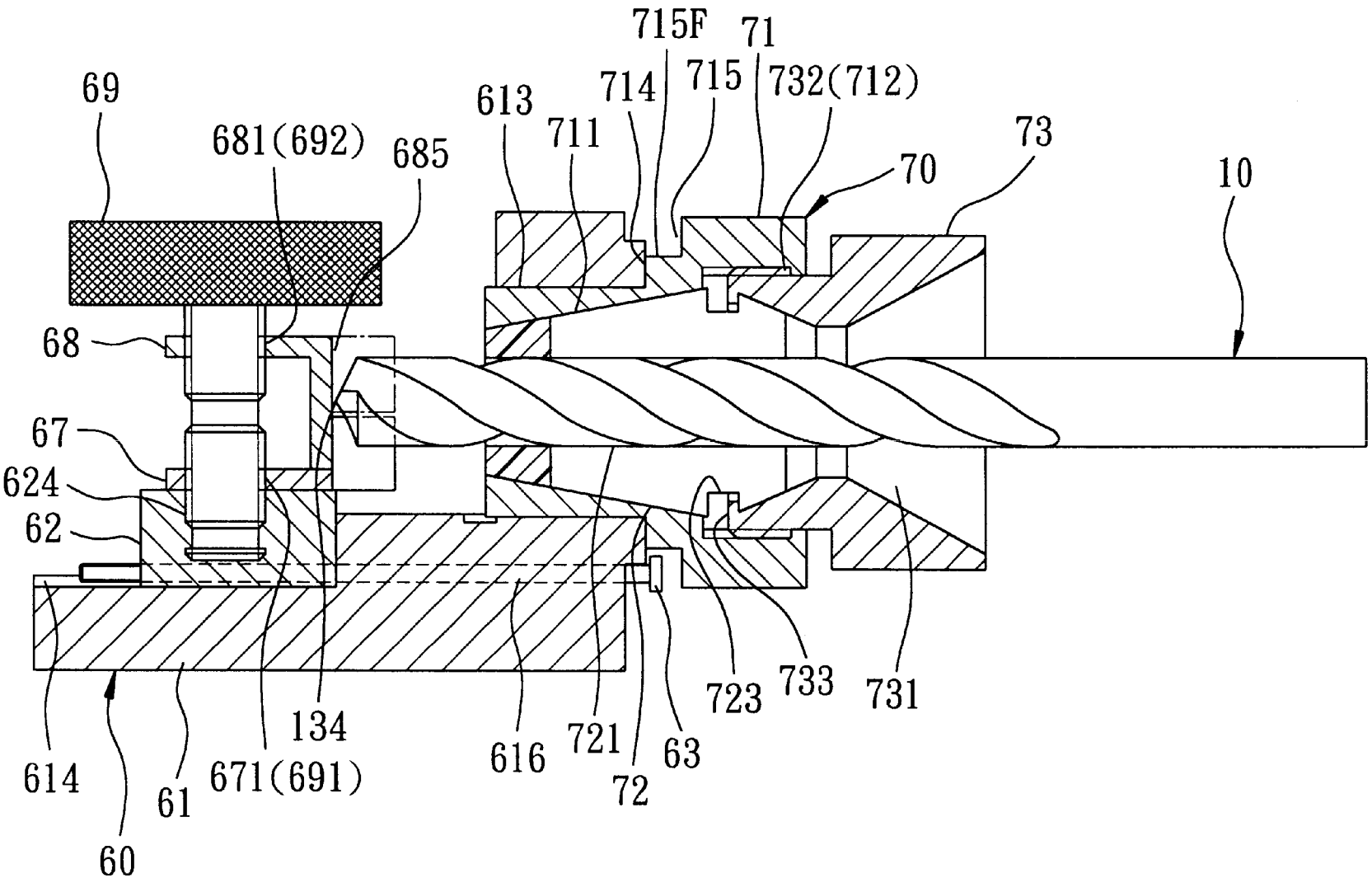
FIG. 6 is a sectional view of the abrasion measuring device, illustrating how the assembly of the holding unit and the drill bit is positioned in the abrasion measuring device.
Figure 7:
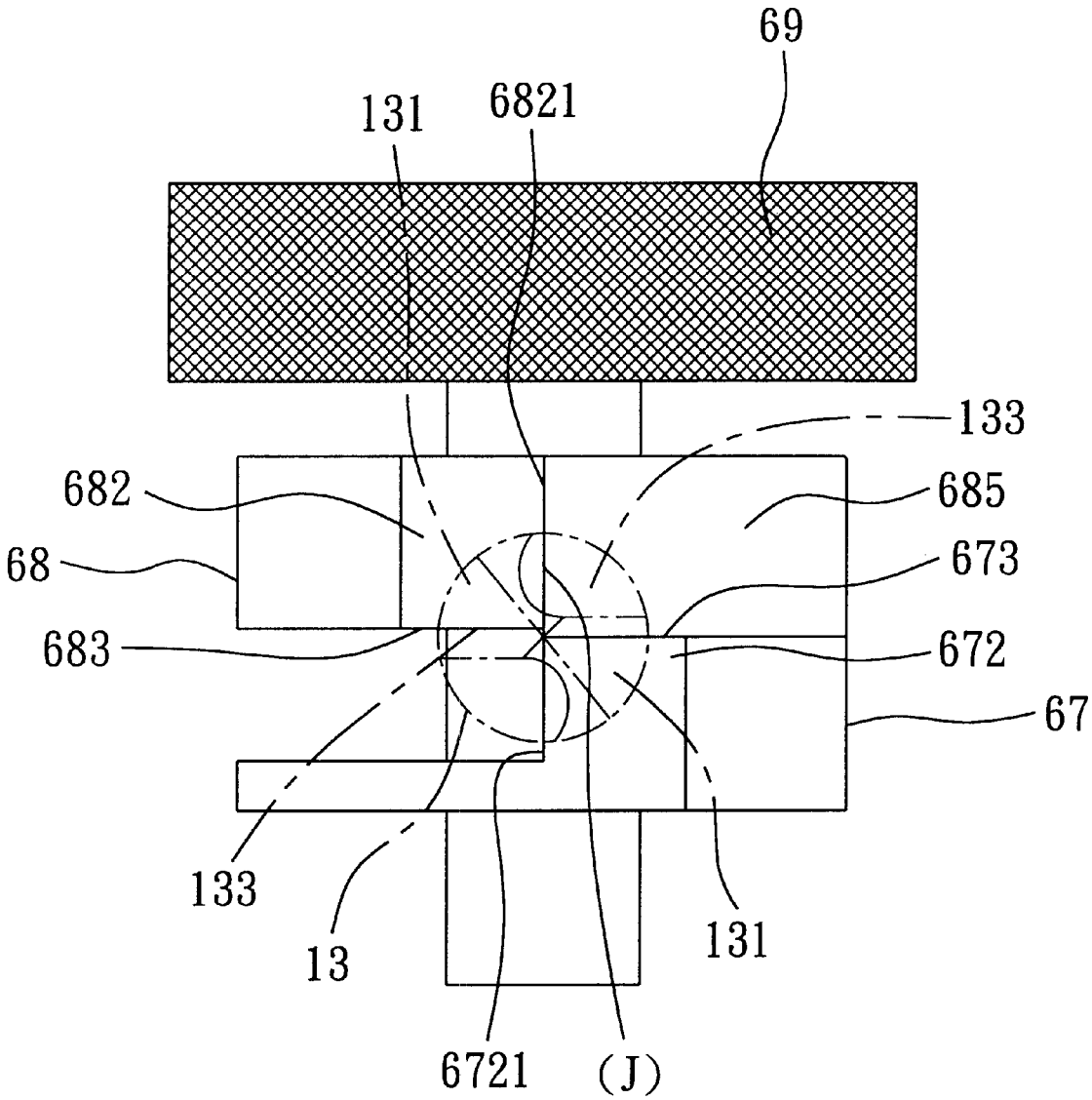
FIGS. 7 and 8 illustrate how the drill bit is clamped between reference plates of the abrasion measuring device.

Referring to FIGS. 1, 2, 3, 5, 6, 7 and 8, the abrasion measuring device 60 is provided for measuring the amount of the flank portions 131 of the drill bit 10 to be ground, and includes a base seat 61, a positioning piece 62, two reference plates 67, 68, and a second bolt 69. The base seat 61 is formed with a through hole 613, and includes a vertical plate 611, a bottom plate 612, two spaced-apart parallel sliding rails 614, and a scale 617. The vertical plate 611 is formed with the through hole 613, a bolt hole 616 (see FIG. 6), and a front surface, which is formed with an engaging protrusion 615. The bottom plate 612 extends integrally and rearwardly from a lower end of the vertical plate 611. The two sliding rails 614 are fixed on the bottom plate 612 behind the vertical plate 611 of the base seat 61, and extends in a direction parallel to the X-axis. The scale 617 is marked on one of the sliding rails 614 for indicating the amount of the flank portions 131 of the drill bit 10 to be ground by the grinding wheel 20. The positioning piece 62 is disposed adjustably on the base seat 61, and has a horizontal top surface 621, which is formed with a threaded hole 624 that extends along a vertical direction, and a post 625 that extends integrally and upwardly from the horizontal top surface 621 and that has a rectangular cross-section. The two reference plates 67, 68 are arranged one above another, and are formed respectively-with a left-hand threaded hole 671 and a right-hand threaded hole 681. Each of the reference plates 67, 68 has a horizontal abutment face 673, 683, an inclined abutment face 672, 682 connected to the horizontal abutment face 673, 683 and having a lateral side 6721, 6821, and a rectangular guide hole 674, 684 for extension of the post 625 there through. The lateral sides 6721, 6821 of the inclined abutment faces 672, 682 are aligned with each other, and form a junction line (J) between the inclined abutment faces 672, 682 when the reference plates 67, 68 are moved toward each other, as best illustrated in FIG. 7. The second bolt 69 has a left-hand threaded portion 691 and a right-hand threaded portion 692, which engage respectively the left-hand threaded hole 671 and the right-hand threaded hole 681 in the reference plates 67, 68.

The abrasion measuring device 60 further includes an adjustment bolt 63, which is journalled within the bolt hole 616 (see FIG. 6) in the vertical plate 611 of the base seat 61 and which is connected threadedly to the positioning piece 62 so that the adjustment bolt 63 can be rotated relative to the base seat 61 to move the positioning piece 62 along the sliding rails 614 to a predetermined position according to the amount of the flank portions 131 of the drill bit 10 to be ground, as best illustrated in FIG. 6.

Referring to FIGS. 1, 2, 3, 4 and 6, the tubular holding unit 70 is sleeved on the drill bit 10, and holds the drill bit 10 releaseably therein. The holding unit 70 has a rear end surface 714 and two diametrically opposed engagement portions 715 (only one is visible in FIG. 4), and is insertable into the eccentric hole 43 in the sleeve 40 so as to engage the engagement portion 4211 of the sleeve 40 with a selected one of the engagement portions 715 of the holding unit 70 such that the holding unit 70 can rotate synchronously with the sleeve 40, and such that an assembly of the drill bit 10 and the holding unit 70 can move within the sleeve 40 in a rearward direction toward the grinding wheel 20 for grinding of the drill bit 10 until the rear end surface 714 of the holding unit 70 abuts against the front end: surface 421 of the front flange 42 of the sleeve 40. The holding unit 70 includes a coupling seat 71, a clamp member 72, and a tubular locking member 73. The coupling seat 71 has a large-diameter front seat portion (71F) with an internally threaded front end 712, and a small-diameter rear seat portion (71R) with a rear end that is formed with a tapered hole 711, which converges rearwardly and which has a maximum diameter smaller than the inner diameter of the internally threaded front end 712. The large-diameter front seat portion (71F) has an outer diameter which is larger than that of the small-diameter rear seat portion (71R), and a rear end surface 714 that is formed with an upper peripheral notch and a lower peripheral notch, which constitute the engagement portions 715 of the holding unit 70 and which are defined by notch-defining faces (715F). The engaging protrusion 615 on the vertical plate 611 of the abrasion measuring device 60 engages a selected one of the engagement portions 715 of the holding unit 70 to fix angular position of the holding unit 70 relative to the base seat 61 of the abrasion measuring device 60. The clamp member 72 includes a tapered peripheral wall 722, which is inserted into the tapered hole 711 in the coupling seat 71, which defines a central hole 721, and which is formed with a plurality of open-ended slits 724, each of which extends along the length of the peripheral wall 722 and has an open front end so as to define a plurality of clamping arms 725. The clamping arms 725 have front end portions, which are formed respectively with circumferentially extending grooves 7251 in outer surfaces thereof that constitute cooperatively an annular groove unit 723 at a front end portion 726 of the clamp member 72. The tubular locking member 73 has a through hole 731, and an externally threaded rear end 732, which engages threadedly the internally threaded front end 712 of the coupling seat 71, which is sleeved around the front end portion 726 of the clamp member 72, and which is formed with an inward flange 733 (see FIG. 6) that extends integrally, radially, and inwardly therefrom and that engages the annular groove unit 723 in the clamp member 72 so that the clamping arms 725 of the clamp member 72 are pressed radially and inwardly against the drill bit 10, thereby locking the drill bit 10 within the clamp member 72.

The holding unit 70 is sleeved on the drill bit 10, and is disposed initially in the abrasion measuring device 60 so as to fix position of the drill bit 10 within the holding unit 70 based on the amount of the flank portions 131 of the drill bit 10 to be ground, and is then transferred and inserted into the eccentric hole 43 in the sleeve 40 such that the drill bit 10 is in an inclined position within the through hole 313 in the first grinding seat 30, so that the flank portions 131 of the drill bit 10 can be ground on the grinding wheel 20 by engaging the engagement portion 4211 of the sleeve 40 with the engagement portions 715 of the holding unit 70 consecutively and by rotating and moving the assembly of the drill bit 10 and the holding unit 70 rearwardly relative to the grinding wheel 20.

Figure 11:
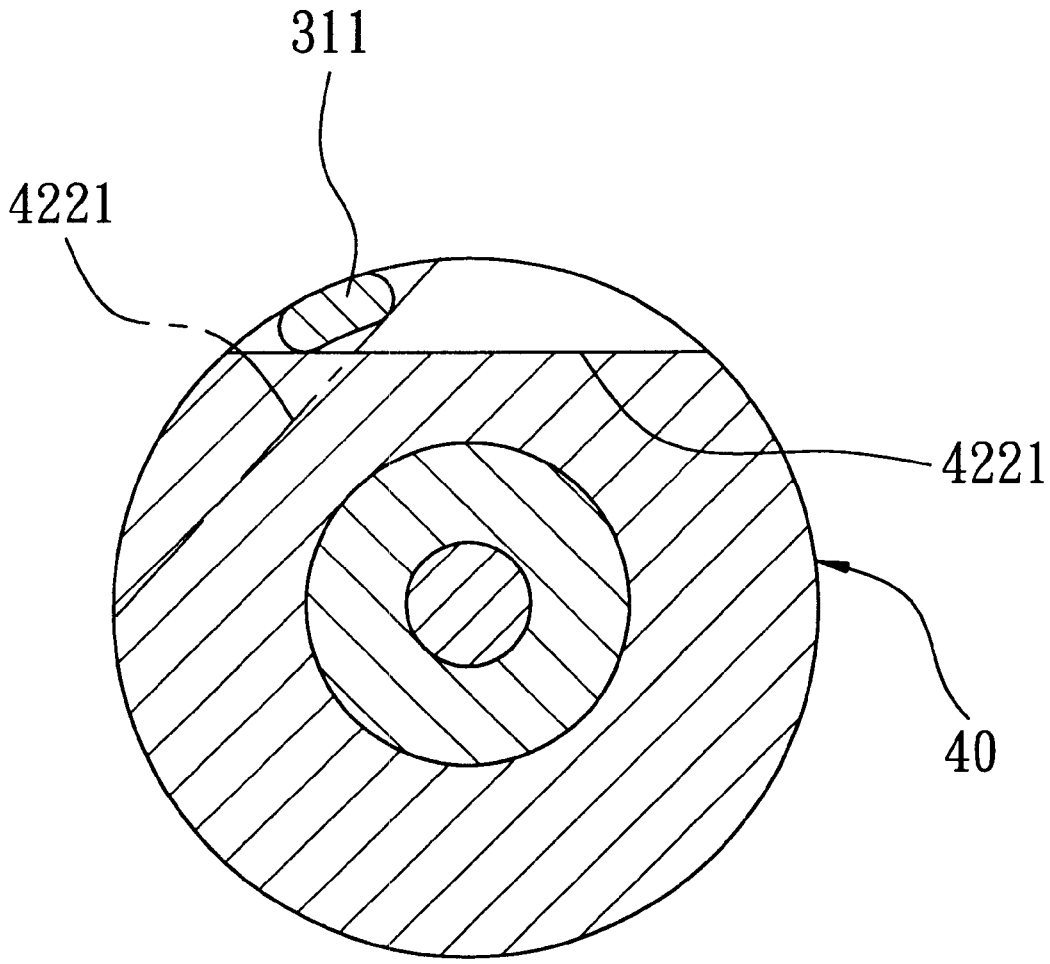
FIG. 11 is a sectional view taken from line XI—XI of FIG. 10.

The limiting projection 311 (see FIGS. 10 and 11) on the first grinding seat 30 can rotate within the peripheral notch 4221 in the rear end surface 422 of the sleeve 40 by turning the assembly of the drill bit 10 and the holding unit 70 relative to the first grinding seat 30, such that the rotation range of the sleeve 40 relative to the first grinding seat 30 is limited, as best illustrated in FIGS. 10 and 11. As such, only the flank portions 131 of the drill bit 10 can be ground at this time.

Referring to FIGS. 1 to 8, the reference plate 68 further includes an integral vertical stop plate portion 685 (see FIG. 5) that is adapted to be disposed behind the drill bit 10 so as to define a rear limit position of the drill bit 10 immediately in front of the stop plate portion 685 when the assembly of the drill bit 10 and the holding unit 70 is inserted into the through hole 613 in the base seat 61 of the abrasion measuring device 60.

Figure 8:
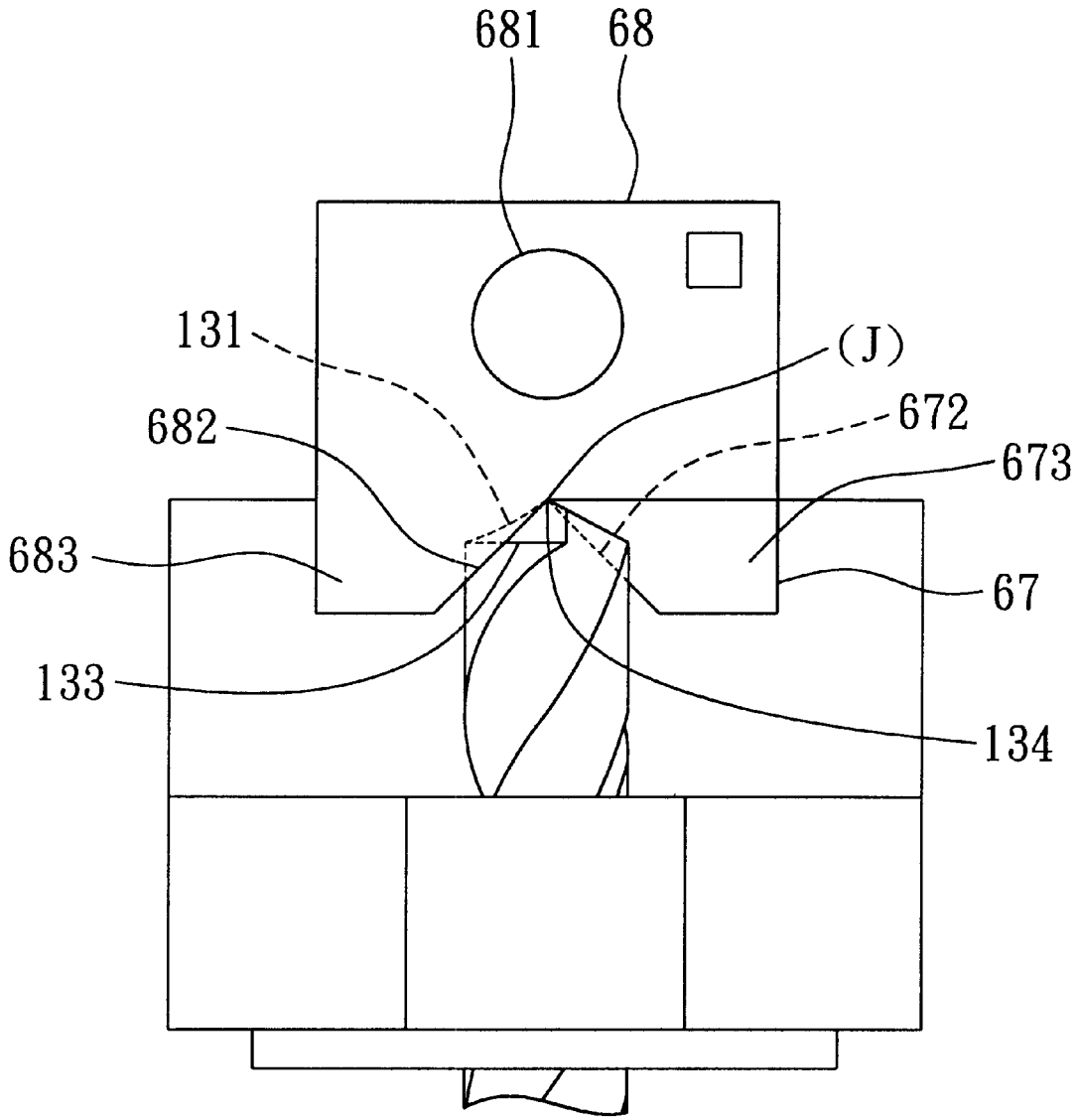

The second bolt 69 is rotatable relative to the positioning piece 62 to move the reference plates 67, 68 toward each other when the assembly of the drill bit 10 and the holding unit 70 is inserted into the through hole 613 in the base seat 61, when the drill bit 10 is released from the holding unit 70 by loosening the locking member 73 from the coupling seat 71, and when the apex 134 of the drill bit 10 is brought into contact with the junction line (J) between the inclined abutment faces 672, 682 of the reference plates 67, 68, as best illustrated in FIG. 8, so as to rotate the drill bit 10 until the cutting edges 133 of the drill bit 10 abut respectively against the horizontal abutment faces 673, 683 of the reference plates 67, 68, after which the locking member 73 is tightened relative to the coupling seat 71 so as to lock the drill bit 10 within the holding unit 70.

The limiting piece 52 of the second grinding seat 50 engages a selected one of the upper and lower peripheral notches 715 in the coupling seat 71 when the assembly of the drill bit 10 and the holding unit 70 is inserted downwardly into the through hole 51 in the second grinding seat 50 for grinding of the drill bit 10, and is rotatable within each of the upper and lower peripheral notches 715 in the coupling seat 71 when the assembly of the drill bit 10 and the holding unit 70 is rotated relative to the second grinding seat 50 so as to limit the rotation range of the holding unit 70 within the through hole 51 in the second grinding seat 50. As such, only the lip portions 132 of the drill bit 10 can be ground at this time.

Therefore, the assembly of the drill bit 10 and the holding unit 70 can be disposed on the first grinding seat 30 for grinding of the flank portions 131 of the drill bit 10, and on the second grinding seat 50 for grinding of the lip portions 132 of the drill bit 10.

Referring back to FIG. 6, to prepare the drill bit 10 for a grinding operation, the body portion 12 of the drill bit 10 is inserted into the central hole 721 in the clamp member 72 and the tapered hole 711 in the coupling seat 71 of the holding unit 70, after which the locking member 73 is brought to engage the coupling seat 71 such that the shank and tip portions 11, 13 of the drill bit 10 extend out of the tapered hole 711 in the coupling seat 71 and the through hole 731 in the locking member 73.

The assembly of the holding unit 70 and the drill bit 10 is then inserted into the through hole 613 in the abrasion measuring device 60. At this time, the assembly of the holding unit 70 and the drill bit 10 is in a loosened state so as to permit rotation of the drill bit 10 relative to the holding unit 70, and the engaging protrusion 615 on the vertical plate 611 engages a selected one of the engagement portions 715 of the holding unit 70 so that the notch-defining faces (715F) of the holding unit 70, the horizontal abutment faces 673, 683 of the reference plates 67, 68, and the Y-axis are maintained in a parallel state. Then, the adjustment bolt 63 is rotated so as to move the positioning piece 62 to a predetermined position, the second bolt 69 is rotated so as to move the reference plates 67, 68 toward each other, and the drill bit 10 is rotated at the same time until the cutting edges 133 of the drill bit 10 abut respectively against the horizontal abutment faces 673, 683 of the reference plates 67, 68. The drill bit 10 is moved rearwardly within the holding unit 70 until the apex 134 of the drill bit 10 is in contact with the junction line (J). Afterwards, the locking member 73 of the holding unit 70 is tightened such that the position of the drill bit 10 within the holding unit 70 is fixed.

Figure 12:
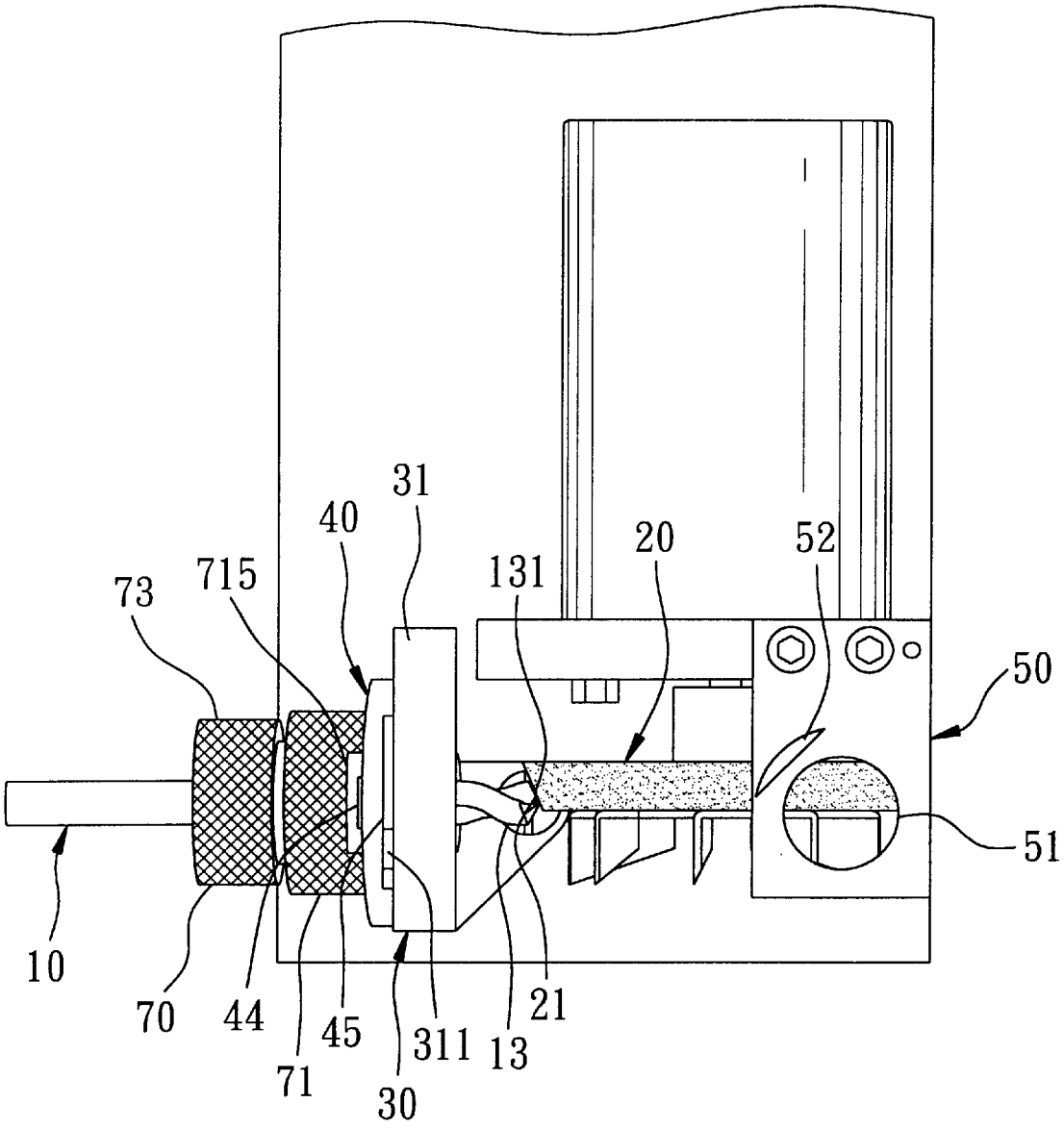
FIG. 12 is a schematic top view illustrating the position of the assembly of the drill bit and the holding unit on the first grinding seat for grinding one flank portion of the drill bit.
Figure 13:
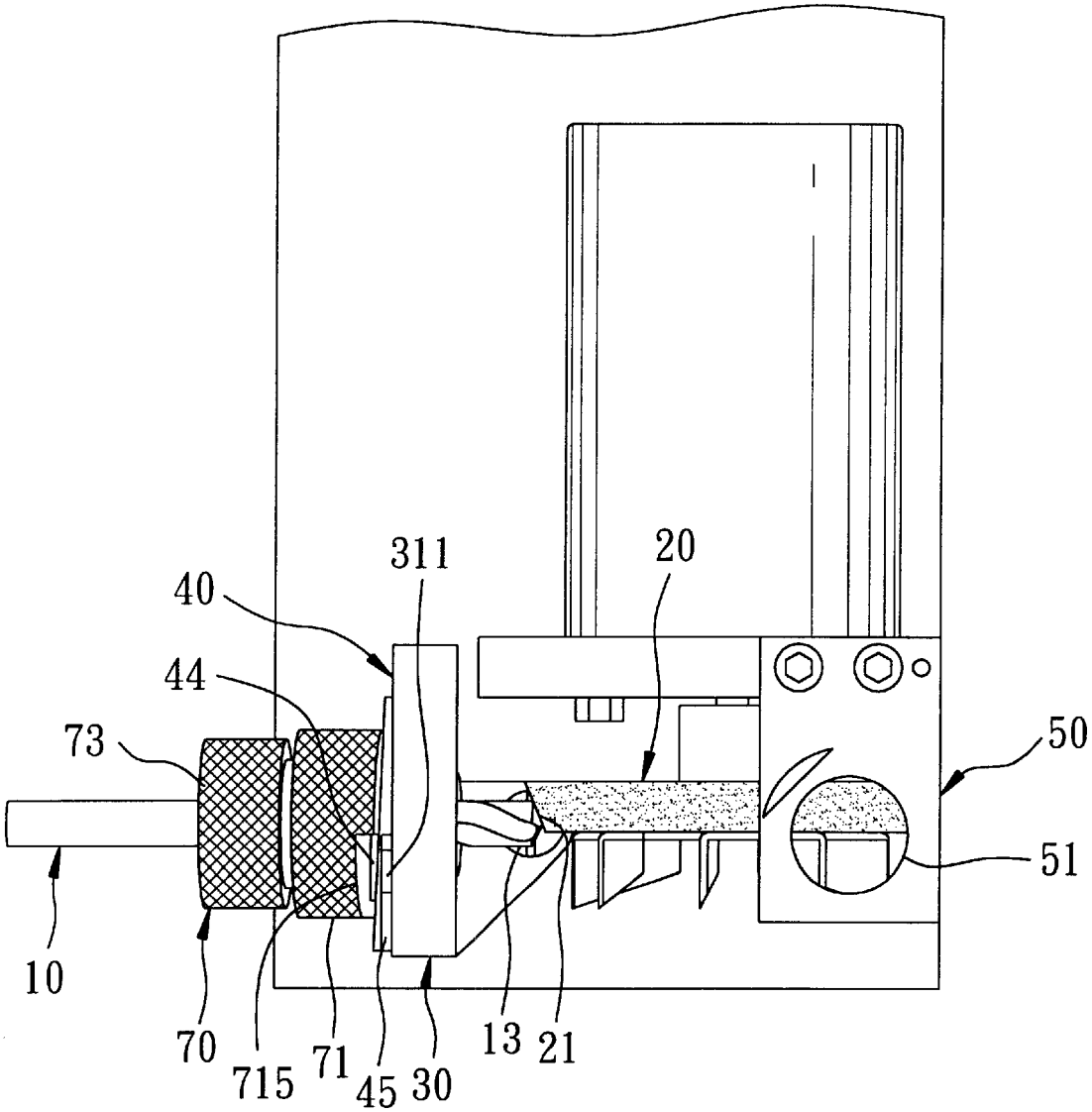
FIG. 13 illustrates another position of the assembly of the drill bit and the holding unit on the first grinding seat for grinding the other flank portion of the drill bit.

After the drill bit 10 is fixed within the holding unit 70 in the abrasion measuring device 60, the assembly of the drill bit 10 and the holding unit 70 is then transferred and inserted into the eccentric hole 43 in the sleeve 40. The engagement portion 4211 (see FIG. 9) of the sleeve 40 engages one of the engagement portions 715 of the holding unit 70 at this time. The grinding wheel 20 is activated after abutting one of the flank portions 131 against the grinding surface 21, as shown in FIG. 12, and the drill bit 10 is pushed rearwardly toward the grinding wheel 20 until the rear end surface 714 of the holding unit 70 abuts against the front end surface 421 of the sleeve 40. Afterwards, the position of the assembly of the drill bit 10 and the holding unit 70 is altered, as best illustrated in FIG. 13, so that the other engagement portion 715 of the holding unit 70 engages the engagement portion 4211 of the sleeve 40, thereby permitting grinding of the other flank portion 131 of the drill bit 10. Since the distance between the grinding wheel 20 and the first grinding seat 30 is fixed, the amount of the drill bit 10 to be ground is measured by the difference between the reading on the scale 617 and the distance between the grinding wheel 20 and the first grinding seat 30.

Figure 14:
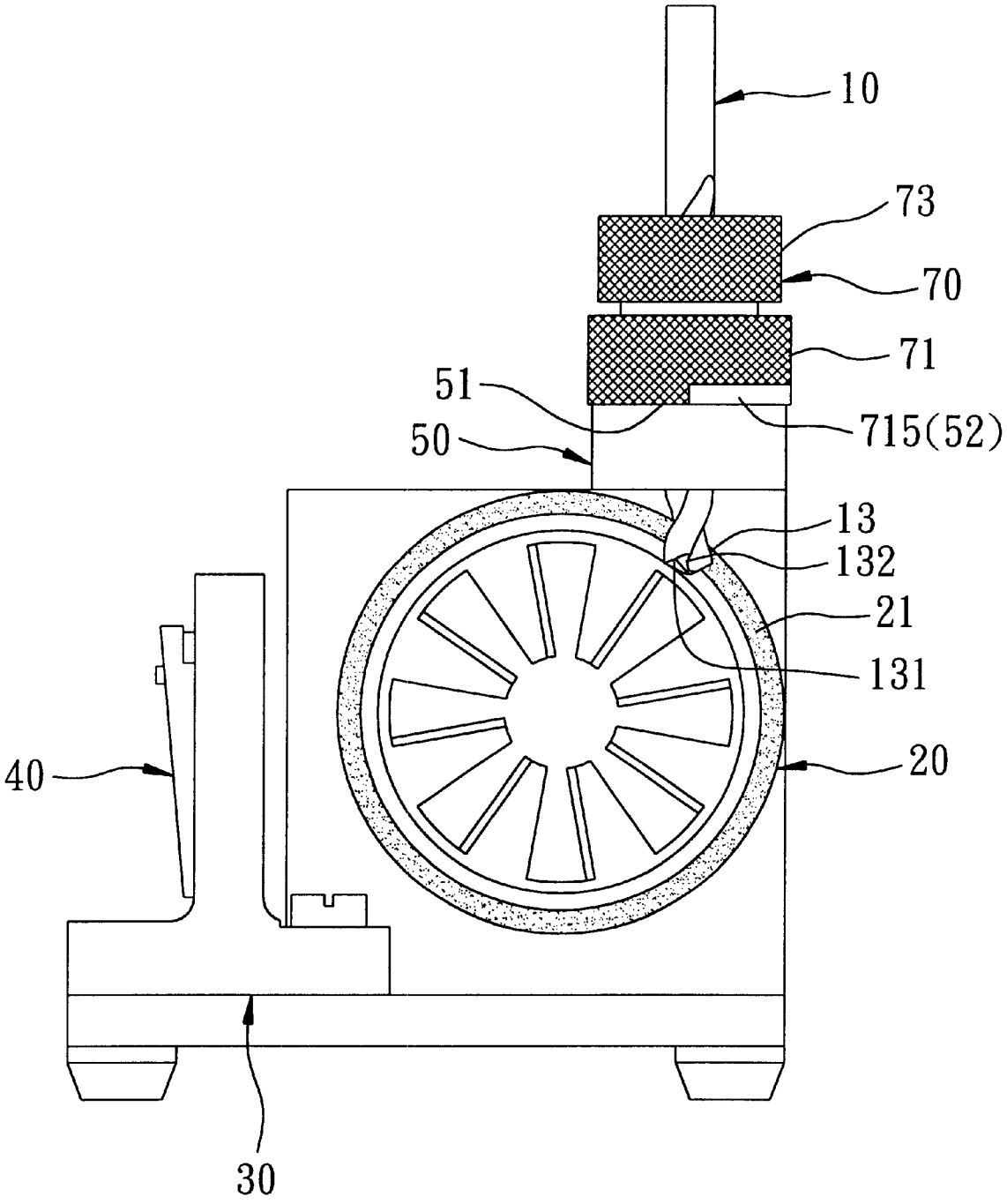
FIG. 14 illustrates the position of the assembly of the drill bit and the holding unit on the second grinding seat for grinding lip portions of the drill bit.

The assembly of the drill bit 10 and the holding unit 70 is then transferred and inserted into the through hole 51 in the second grinding seat 50 after the flank portions 131 of the drill bit 10 are ground to a desired angle. The limiting piece 52 (see FIG. 14) engages one of the engagement portions 715 of the holding unit 70 at this moment so as to limit rotation range of the holding unit 70 within the through hole 51. The grinding wheel 20 is activated after abutting one of the lip portions 132 (see FIG. 14) against the grinding surface 21, and the drill bit 10 is pushed downwardly toward the grinding wheel 20 until the rear end surface 714 of the holding unit 70 abuts against the horizontal top surface of the second grinding seat 50. Afterwards, the position of the assembly of the drill bit 10 and the holding unit 70 is altered so that the other engagement portion 715 of the holding unit 70 engages the limiting piece 52, thereby permitting grinding of the other lip portion 132 of the drill bit 10.

Since there are three different standard tip angles of drill bit 10 used in a drilling operation, that is, 90° for materials having low degree of hardness such as brass, 150° for materials having high degree of hardness such as steel, and 118° for materials having medium degree of hardness such as aluminum, it is necessary to adjust the orientation of the first grinding seat 30 relative to the grinding wheel 20 prior to the grinding operation so as to form the desired tip angle (A) (see FIG. 15) of the drill bit 10.

Figure 16A:
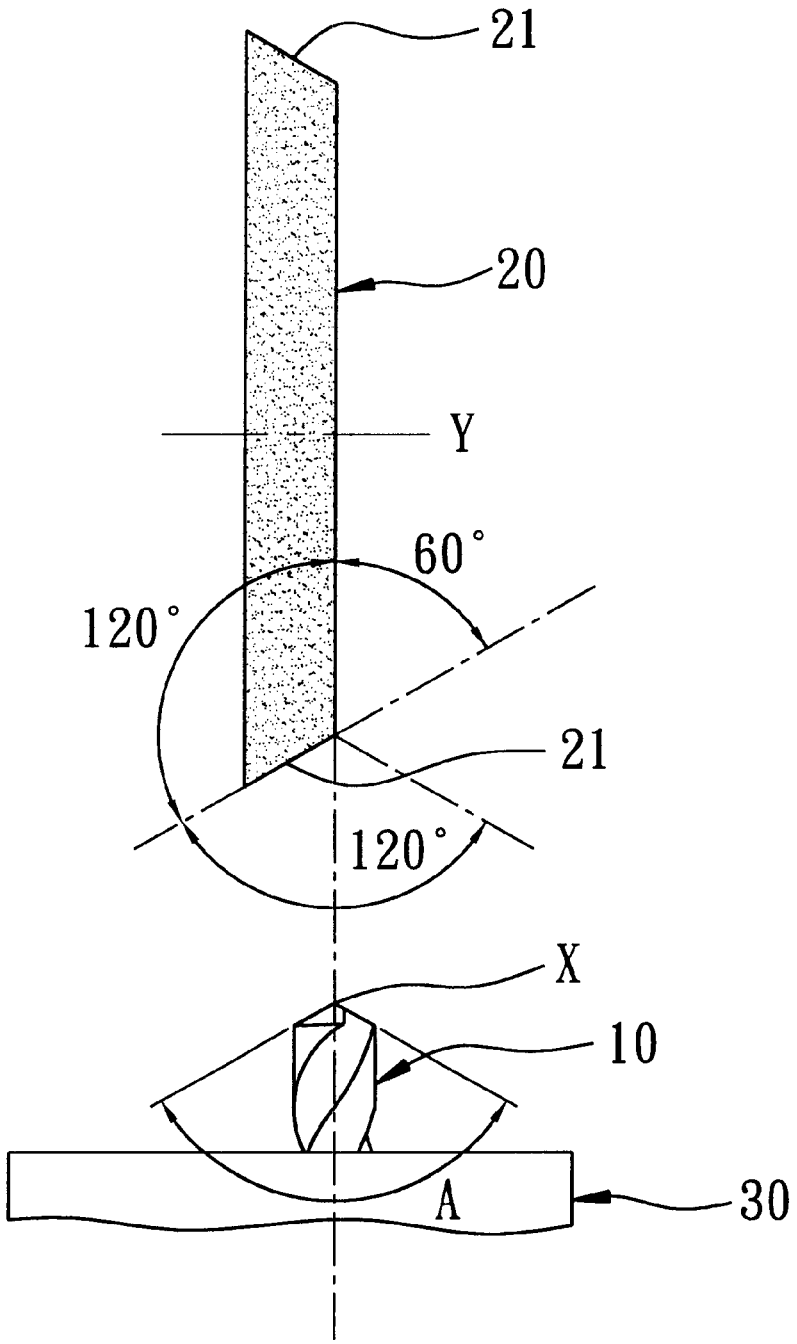
FIGS. 16A and 16B illustrate angular adjustment of the drill bit relative to the grinding wheel.
Figure 16B:
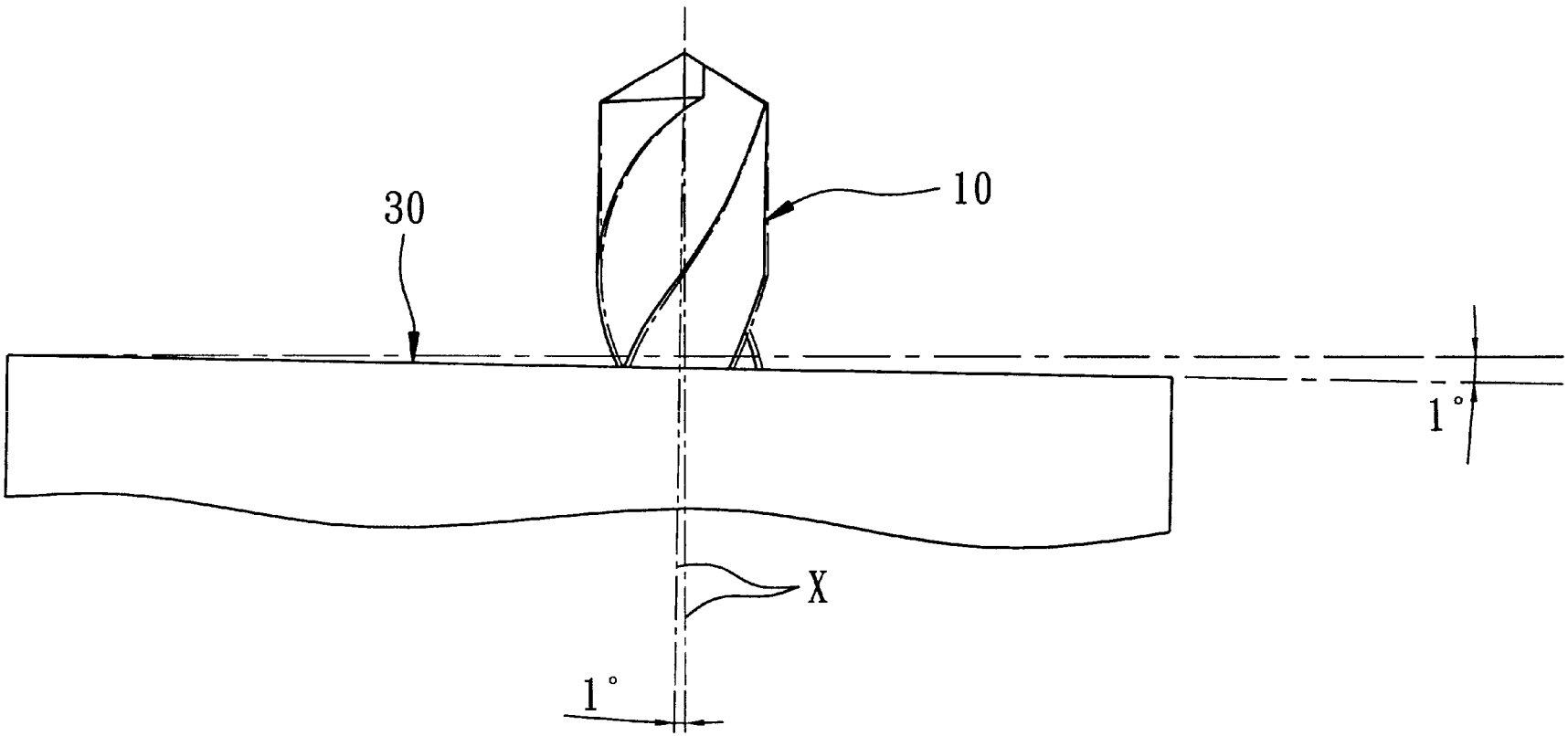

FIGS. 15, 16A and 16B illustrate how to obtain the 118° tip angle (A) of the drill bit 10 to be ground. Since the grinding surface 21 of the grinding wheel 20 has an inclination angle of 60° (see FIG. 16A) with respect to the Y-axis, when the drill bit 10 is moved toward the grinding wheel 20 in a direction perpendicular to the Y-axis, the resulting tip angle (A) of the drill bit 10 is 120°, as shown in FIG. 16A. Thus, when the first grinding seat 30 is turned by 1° (see FIG. 16B) relative to the Y-axis in a clockwise direction so as to turn correspondingly the drill bit 10 from the position shown in FIG. 16A by 1°, the desired 118° (see FIG. 15) tip angle (A) of the drill bit 10 is obtained.

Figure 17:
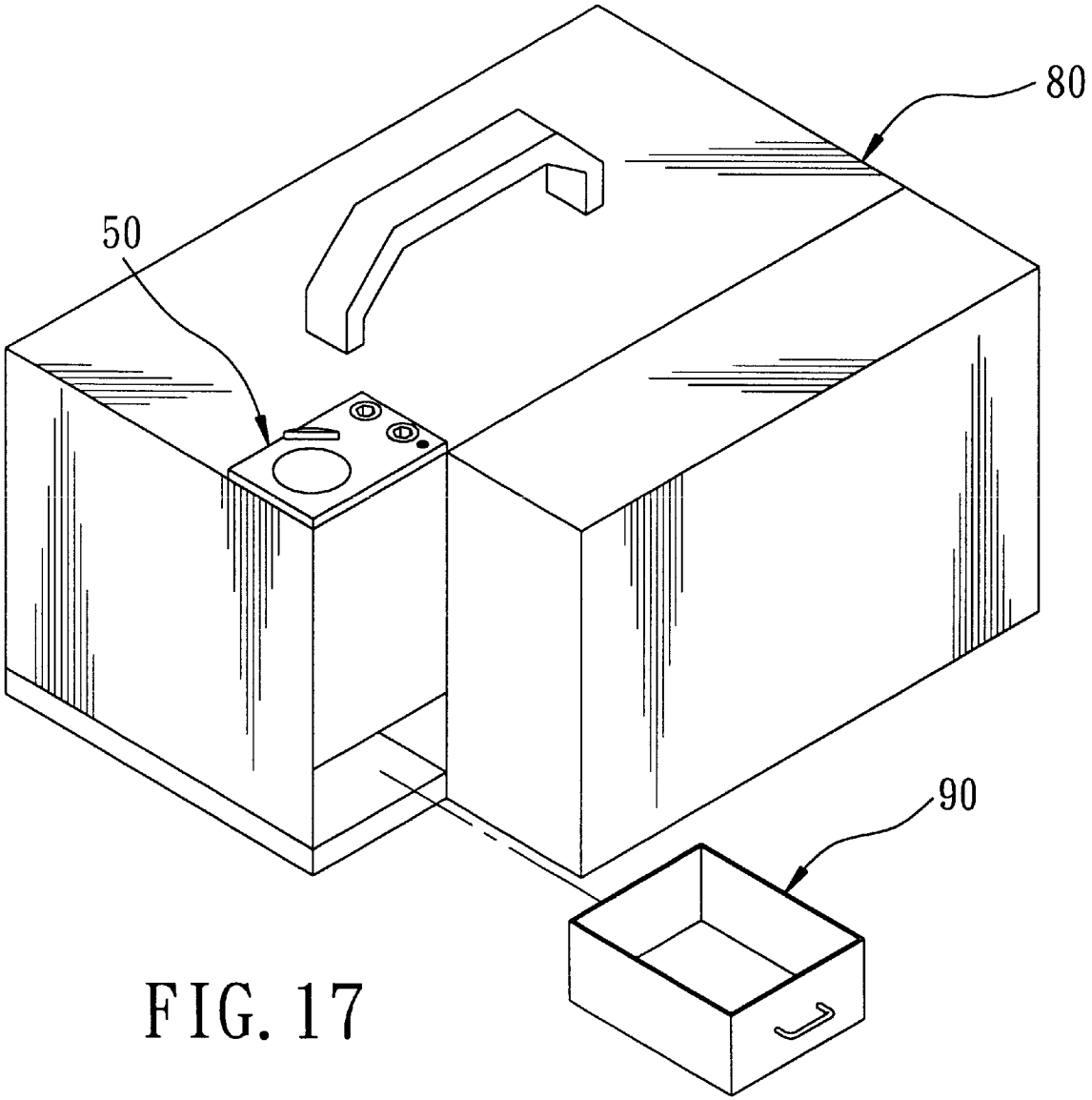
FIG. 17 illustrates a cover and a swarf-receiving drawer of the preferred embodiment.

Referring to FIG. 17, the preferred embodiment further includes a handheld cover 80 and a swarf-receiving drawer 90. The handheld cover 80 does not only cover the grinding device of the present invention, but also enhances the appearance of the same. The swarf-receiving drawer 90 is disposed under the grinding wheel 20, and is used to facilitate collection and disposal of the grinding swarfs produced during the grinding operation.

The advantages of the grinding device of the present invention can be summarized as follows:

1. Elements of the grinding device of the present invention are simple in construction. The amount of the drill bit 10 to be ground can be preset via the abrasion measuring device 60 and through the use of the holding unit 70, after which the assembly of the drill bit 10 and the holding unit 70 is inserted into the first and second grinding seats 30, 50 for grinding the flank and lip portions 131, 132 of the drill bit 10. Thus, the elements of the grinding device of the present. invention are not only simple, but are also easy to operate.

2. The abrasion measuring device 60 can easily position the drill bit 10 relative to the holding unit 70 prior to interlocking thereof, and can set the amount of the drill bit 10 to be ground such that the grinding operation of the drill bit 10 is easy and convenient to conduct.

3. Locking of the drill bit 10 on the holding unit 70 is done only once, and positioning of the assembly of the drill bit 10 and the holding unit 70 during the entire grinding operation is done four times, that is, in the first and second grinding seats 30, 50 for grinding the flank and lip portions 131, 132 of the drill bit 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A grinding device adapted for grinding a drill bit, the drill bit having a tip portion that is formed with an apex, two cutting edges that define a tip angle therebetween, two diametrically opposed lip portions, and two diametrically opposed flank portions, each of which is formed between a respective one of the cutting edges and a respective one of the lip portions, said grinding device comprising:

a horizontal base plate;

a rotary grinding wheel disposed rotatably on said base plate and having an annular grinding surface that is rotatable about a horizontal Y-axis;

a first grinding seat disposed adjustably on said base plate and formed with a through hole that extends along a horizontal X-axis which is perpendicular to said Y-axis, said first grinding seat being located in front of said grinding wheel and being adjustable on said base plate so as to be adapted to vary the tip angle of the drill bit to be formed;

a sleeve disposed rotatably within said through hole in said first grinding seat so as to permit rotation of said sleeve relative to said first grinding seat by a predetermined angle, said sleeve having a front end surface, an engagement portion, and an eccentric hole, which is formed in said front end surface of said sleeve and which extends in a direction that is inclined with respect to said X-axis;

an abrasion measuring device for measuring amount of the flank portions of the drill bit to be ground; and a tubular holding unit for holding the drill bit releaseably therein, said holding unit having a rear end surface and two diametrically opposed engagement portions, and being insertable into said eccentric hole in said sleeve so as to engage said engagement portion of said sleeve with a selected one of said engagement portions of said holding unit such that said holding unit can rotate synchronously with said sleeve, and such that an assembly of the drill bit and said holding unit can move within said sleeve in a rearward direction toward said grinding wheel for grinding of the drill bit until said rear end surface of said holding unit abuts against said front end surface of said sleeve;

wherein said holding unit is sleeved on the drill bit, and is disposed initially in said abrasion measuring device so as to fix position of the drill bit within said holding unit based on the amount of the flank portions of the drill bit to be ground, and is then transferred and inserted into said eccentric hole in said sleeve such that the drill bit is in an inclined position within said through hole in said first grinding seat, so that the flank portions of the drill bit can be ground on said grinding wheel by engaging said engagement portion of said sleeve with said engagement portions of said holding unit consecutively and by rotating and moving the assembly of the drill bit and said holding unit rearwardly toward said grinding wheel.

2. The grinding device of claim 1, wherein said first grinding seat includes a vertical plate, which has a front surface that is formed with a limiting projection, said sleeve further having a rear end surface that is formed with a peripheral notch, within which said limiting projection can rotate by turning the assembly of the drill bit and said holding unit relative to said first grinding seat, whereby, rotation range of said sleeve relative to said first grinding seat is limited.

3. The grinding device of claim 2, wherein said sleeve further has an annular outer surface that is formed with an annular retention groove, said first grinding seat further including a limiting screw that is fixed to said vertical plate of said first grinding seat and that engages said retention groove in said sleeve so as to limit rotation of said sleeve within said through hole in said vertical plate.

4. The grinding device of claim 2, wherein said first grinding seat further includes:

a horizontal bottom plate extending integrally and forwardly from a lower end of said vertical plate and formed with a curved slot that extends therethrough along a vertical direction, and a first bolt extending through said slot in said bottom plate and connected threadedly to said base plate so as to lock said bottom plate releasably on said base plate, thereby permitting adjustment of the tip angle of the drill bit to be formed.

5. The grinding device of claim 1, wherein said holding unit includes:

a coupling seat having a large-diameter front seat portion and a small-diameter rear seat portion that has an outer diameter smaller than that of said front seat portion, said front seat portion having an internally threaded front end, said rear seat portion having a rear end that is formed with a tapered hole, which converges rearwardly and which has a maximum diameter smaller than an inner diameter of said internally threaded front end;

a clamp member including a tapered peripheral wall, which is inserted into said tapered hole in said coupling seat, which defines a central hole, and which is formed with a plurality of open-ended slits, each of which extends along the length of said peripheral wall and has an open front end so as to define a plurality of clamping arms, said clamping arms having front end portions, which are formed respectively with circumferentially extending grooves in outer surfaces thereof that constitute cooperatively an annular groove unit at a front end portion of said clamp member; and a tubular locking member having an externally threaded rear end, which engages threadedly said internally threaded front end of said coupling seat, which is sleeved around said front end portion of said clamp member, and which is formed with an inward flange that extends integrally, radially, and inwardly therefrom and that engages said annular groove unit in said clamp member so that said clamping arms of said clamp member are pressed radially and inwardly against the drill bit, thereby locking the drill bit within said clamp member.

6. The grinding device of claim 5, wherein said engagement portion of said sleeve is a frontwardly protruding rib extending in a direction parallel to said Y-axis, said front seat portion of said coupling seat further having a rear end surface that is formed with an upper peripheral notch and a lower peripheral notch, which constitute said engagement portions of said holding unit.

7. The grinding device of claim 6, further comprising a second grinding seat mounted fixedly on said base plate and located over said grinding wheel, said second grinding seat being formed with a through hole for extension of said holding unit therethrough, and a horizontal top surface with a limiting piece that protrudes integrally and upwardly therefrom and that engages a selected one of said upper and lower peripheral notches in said coupling seat when the assembly of the drill bit and said holding unit is inserted downwardly into said through hole in said second grinding seat for grinding of the drill bit, said limiting piece of said second grinding seat being rotatable within each of said upper and lower peripheral notches in said coupling seat by turning the assembly of the drill bit and said holding unit relative to said second grinding seat so as to limit rotation range of said holding unit within said through hole in said second grinding seat, whereby, the assembly of the drill bit and said holding unit can be disposed on said first grinding seat for grinding of the flank portions, and on said second grinding seat for grinding of the lip portions.

8. The grinding device of claim 1, wherein said abrasion measuring device includes:

a base seat having a through hole for extension of said holding unit therethrough;

a positioning piece disposed adjustably on said base seat and having a horizontal top surface, which is formed with a threaded hole that extends along a vertical direction, and a post that extends integrally and upwardly from said horizontal top surface and that has a rectangular cross-section;

two reference plates arranged one above another and formed respectively with a left-hand threaded hole and a right-hand threaded hole, each of said reference plates further having a horizontal abutment face, an inclined abutment face connected to said horizontal abutment face, and a rectangular guide hole for extension of said post therethrough, one of said reference plates further including an integral vertical stop plate portion that is adapted to be disposed behind the drill bit so as to define a rear limit position of the drill bit immediately in front of said stop plate portion when the assembly of the drill bit and said holding unit is inserted into said-through hole in said base seat; and a second bolt having a left-hand threaded portion and a right-hand threaded portion, which engage respectively said left-hand threaded hole and said right-hand threaded hole in said reference plates, said second bolt being rotatable relative to said positioning piece to move said reference plates toward each other when the assembly of the drill bit and said holding unit is inserted into said through hole in said base seat, when the drill bit is released from said holding unit, and when the apex of the drill bit is brought into contact with a junction line between said inclined abutment faces of said reference plates, so as to rotate the drill bit until the cutting edges of the drill bit abut respectively against said horizontal abutment faces of said reference plates, after which the drill bit can be locked within said holding unit.

9. The grinding device of claim 8, wherein said base seat includes:

a vertical plate formed with said through hole in said base seat, a bolt hole, and a front surface, which is formed with an engaging protrusion for engagement with a selected one of said engagement portions of said holding unit to fix angular position of said holding unit relative to said base seat;

a bottom plate extending integrally and rearwardly from a lower end of said vertical plate;

two spaced-apart parallel sliding rails fixed on said bottom plate behind said vertical plate of said base seat and extending in a direction parallel to said X-axis; and a scale indicated on one of said sliding rails for indicating the amount of the flank portions of the drill bit to be ground by said grinding wheel;

said abrasion measuring device further including an adjustment bolt, which is journalled within said bolt hole in said vertical plate of said base seat and which is connected threadedly to said positioning piece so that said adjustment bolt can be rotated relative to said base seat to move said positioning piece along said sliding rails to a predetermined position according to the amount of the flank portions of the drill bit to be ground.

10. The grinding device of claim 1, wherein said grinding surface of said grinding wheel has an inclination angle of about 60° with respect to said Y-axis.

11. The grinding device of claim 10, wherein said front end surface of said sleeve is inclined with respect to a vertical line, and said eccentric hole in said sleeve extends along a straight path that is perpendicular to said front end surface of said sleeve and that is inclined rearwardly and upwardly.

12. The grinding device of claim 11, wherein said front end surface of said sleeve forms an angle of about 5° with respect to the vertical line.

* * * * *